United States Patent [19]

Lindsay

[11] Patent Number: 5,063,661

[45] Date of Patent: Nov. 12, 1991

[54] METHOD OF FABRICATING A SPLIT COMPRESSOR CASE

[75] Inventor: Mitchell H. Lindsay, Palm City, Fla.

[73] Assignee: The United States of America as represented by the Secretary of the Air Force., Washington, D.C.

[21] Appl. No.: 548,656

[22] Filed: Jul. 5, 1990

[51] Int. Cl.[5] ..... F01D 25/24

[52] U.S. Cl. ..... 29/888.02; 29/405; 29/445; 415/219.1

[58] Field of Search ..... 29/888.02, 405, 445, 29/465, 557; 415/219.1

[56] References Cited

U.S. PATENT DOCUMENTS

| | | | |
|---|---|---|---|
| 1,269,832 | 6/1918 | Martell . | |
| 1,677,264 | 7/1928 | Barney . | |
| 4,128,928 | 12/1978 | Shotts et al. | 29/156.8 B |
| 4,137,006 | 1/1979 | Becker | 29/888.02 |
| 4,305,192 | 12/1981 | Becker | 29/888.02 |
| 4,308,655 | 1/1982 | Berger | 29/463 |
| 4,551,065 | 11/1985 | Becker | 29/888.02 |

*Primary Examiner*—Irene Cuda

*Attorney, Agent, or Firm*—Bobby D. Scearce; Donald J. Singer

[57] ABSTRACT

A method for fabricating a split compressor case for a gas turbine engine is described which comprises the steps of assembling the two axial sections of the split case along corresponding flanges of the sections with a flat shim disposed between corresponding flanges and machining this first assembly to preselected contour, determining the degree of ovalization of the first assembly at the engine operating temperature as a function of axial extent of the assembly, assembling the two axial sections with a pair of tapered shims each having thickness which varies along the length and width thereof in correspondence with the determination of ovalization of the first assembly as a function of axial extent whereby ovalization is substantially eliminated at the engine operating temperature in an assembly of the axial sections and tapered shims.

4 Claims, 1 Drawing Sheet

METHOD OF FABRICATING A SPLIT COMPRESSOR CASE

RIGHTS OF THE GOVERNMENT

The invention described herein may be manufactured and used by or for the Government of the United States for all governmental purposes without the payment of any royalty.

BACKGROUND OF THE INVENTION

The present invention relates generally to methods for fabrication of compressor cases for gas turbine engines, and more particularly to a method for fabricating a split compressor case to avoid ovalization during hot operation of the engine.

A common configuration for a compressor case of a gas turbine engine includes a split case structure including two case halves assembled along a common axial plane at a pair of flanges. Operating tests on certain engines incorporating this structure indicate a potential problem with ovalization of the compressor case during hot operation. Simulations of the compressor split case indicate that non-uniform deflections may be related to flanges which join the case. One solution is to machine the split case with an oval internal shape which would theoretically compensate for case ovalization at hot operating temperatures, but would require multiple machining passes on the compressor case.

The invention solves or substantially reduces in critical importance problems with existing fabrication methods for split compressor cases by providing methods for machining and assembling an engine case in an out-of-round condition utilizing suitably shaped shims at the flanges to produce a case that will distort to the correct contours at engine operating temperatures.

It is therefore a principal object of the invention to provide a method for fabrication of a split compressor case for a gas turbine engine.

It is a further object of the invention to provide a method for fabrication of a split compressor case to avoid ovalization during hot operation of the engine.

These and other objects of the invention will become apparent as a detailed description of representative embodiments proceeds.

SUMMARY OF THE INVENTION

In accordance with the foregoing principles and objects of the invention, a method for fabricating a split compressor case for a gas turbine engine is described which comprises the steps of assembling the two axial sections of the split case along corresponding flanges of the sections with a flat shim disposed between corresponding flanges and machining this first assembly to preselected contour, determining the degree of ovalization of the first assembly at the engine operating temperature as a function of axial extent of the assembly, assembling the two axial sections with a pair of tapered shims each having thickness which varies along the length and width thereof in correspondence with the determination of ovalization of the first assembly as a function of axial extent whereby ovalization is substantially eliminated at the engine operating temperature in an assembly of the axial sections and tapered shims.

DESCRIPTION OF THE DRAWINGS

The invention will be more clearly understood from the following detailed description of representative embodiments thereof read in conjunction with the accompanying drawings wherein.

DETAILED DESCRIPTION

Figure 1:
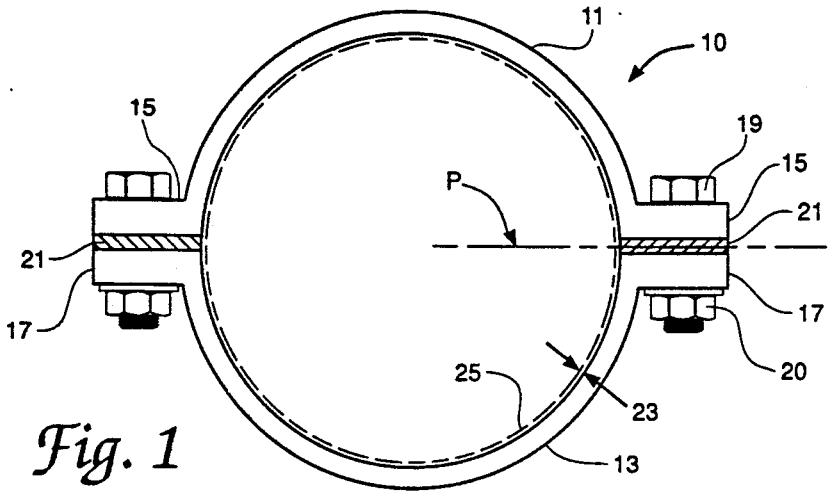
FIG. 1 is a sectional view of a split compressor case and flange.

Referring now to the drawings, FIG. 1 shows a sectional view of the flange region of a cold split case during machining in the practice of the method of the invention. A compressor case 10 of the type contemplated herein comprises two sections 11,13 which are assembled substantially along a common axial plane P. Each section 11,13 has a pair of flanges 15,17 along each side thereof for assembly using a plurality of bolts and nuts 19,20. In one method contemplated herein, compressor split cases are machined to desired preselected contour in the assembled condition shown in FIG. 1 with a pair of flat shims 21 inserted between flanges 15,17. In this procedure, shims 21 are flat and of uniform thickness along the length thereof from the inside to the outside edges thereof. A uniform clearance 23 is machined around the inner periphery of the assembled sections 11,13 to receive with preselected tolerance an engine component (e.g. compressor) 25.

Figure 2:
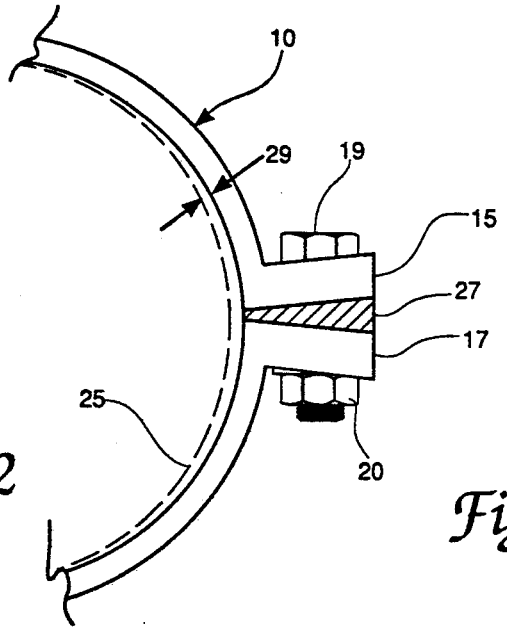
FIG. 2 is a partial sectional view of the flange region of the FIG. 1 case in the cold assembled condition for operation.

After sections 11,13 are machined as described above, shims 21 are removed and replaced with tapered shims 27 as suggested in the partial sectional view of FIG. 2. In the assembled condition of sections 11,13 with shims 27 in place, a non-uniform clearance 29 is defined around the inner periphery of sections 11,13 around engine component 25. Case 10 may be constructed of any of the high temperature resistant metals or alloys as are well known in the turbine engine art. Accordingly, shims 21,27 comprise alloys selected to be compatible with the material selected for case 10 considering the environmental conditions to which the case and shim assembly is to be exposed, material selection not considered limiting of the invention. Additional shims (not shown) under the heads of bolts 19 may be required to ensure proper alignment of bolts 19 within flanges 15,17, or the holes in flanges 15,17 receiving bolts 19 may be suitably machined to accommodate proper alignment of bolts 19 in the assembled condition.

Figure 4:
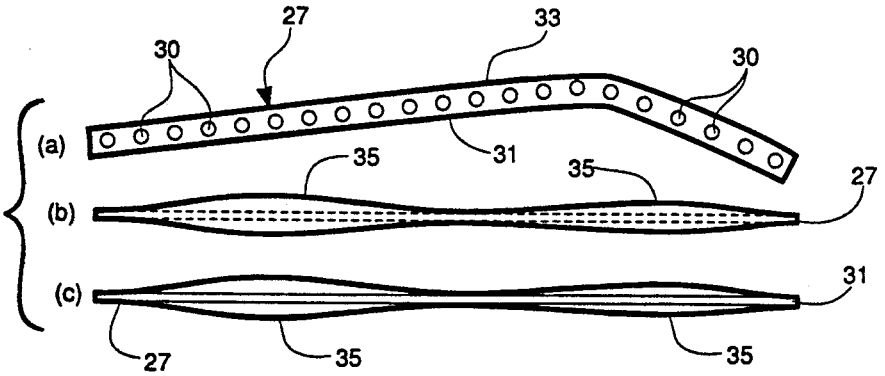
FIGS. 4*a,b,c* are top, outside edge and inside edge views of a representative shim used in assembling the case of FIGS. 2 and 3 for hot engine operation.

Referring now to FIGS. 4*a,b,c*, shown therein are respective top, outside edge and inside edge views of a representative shim 27 used in assembling case 10 of FIG. 2 for hot engine operation. In the assembled condition shown in FIG. 2 and during hot operation of engine component 25 and case 10, ovalization of case 10 will vary with the axial extent thereof in a predictable fashion. The degree of ovalization as a function of axial extent of case 10 can be determined from model simulations or actual hot test data on engine operation. Accordingly, tapered shim 27 will take the general form illustrated in FIGS. 4*a,b,c* including a plurality of holes 30 spaced for registration with holes in flanges 15,17 for receiving bolts 19, and wherein the thickness thereof will vary in predetermined fashion along the length thereof and from inside edge 31 to outside edge 33. It is noted therefore, that inside edge 31 will normally have continuous thickness along the length thereof as illustrated in FIG. 4c, whereas outside edge 33 will have a thickness which varies with length in a predetermined way according to the test data. Shim 27 will normally comprise one or more wedge shaped bulges 35 along the length thereof in order to selectively shim flanges 15,17 along the length of case 10 so that the degree of ovalization along the axial extent of case 10 is predictably compensated for under hot engine operating conditions.

It is noted that a significant advantage of the method of the first embodiment is that the shape of shim 27 may be modified and optimized consistent with the accumulation of test and hot operational data on case 10. No additional machining on case 10 would be required to accommodate observed ovalization.

Figure 3:
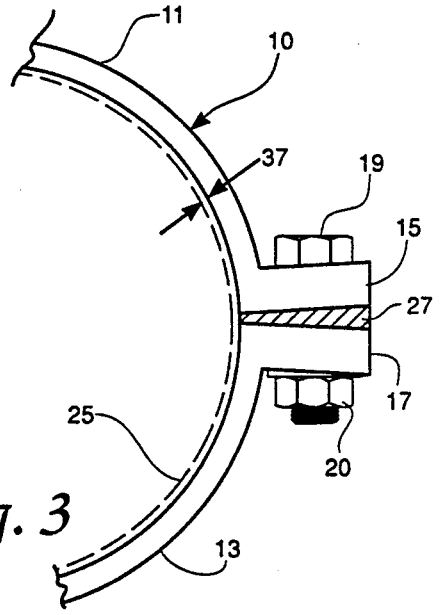
FIG. 3 is a partial sectional view of the flange region of the FIG. 2 case during hot operation.

In an alternative embodiment of the invention, and with reference now to FIG. 3, assembly of case sections 11,13 for machining may be performed with shims 27 in place between flanges 15,17 instead of shims 21. Machining of the inner surface of the assembled case 10 to a uniform clearance 37 then results in an inner contour corresponding to that which exists during hot operation of the engine. After machining, sections 11,13 are assembled with a flat shim 21 between flanges 15,17 which assembly pulls the inner contour of case 10 to a configuration which expands to the desired contour when brought to hot engine operation temperature.

The invention therefore provides a method for fabricating a split compressor case for a gas turbine engine to provide a case structure wherein ovalization during hot operation of the engine is avoided. It is understood that modifications to the invention may be made as might occur to one with skill in the field of the invention within the scope of the appended claims. All embodiments contemplated hereunder which achieve the objects of the invention have therefore not been shown in complete detail. Other embodiments may be developed without departing from the spirit of the invention or from the scope of the appended claims.

I claim:

1. A method for fabrication of a split compressor case for a gas turbine engine, comprising the steps of:

(a) providing two axial sections defining a split compressor case, said axial sections each having a pair of flanges along the axial extent thereof;

(b) assembling said two axial sections along corresponding said flanges with a flat shim disposed between each corresponding pair of flanges in a first assembly of said two axial sections;

(c) machining said first assembly to a preselected contour;

(d) determining, as a function of axial extent of said first assembly, the degree of ovalization f said first assembly when heated to the hot operating temperature of said engine;

(e) providing a pair of tapered shims each having thickness which varies along the length and width thereof in correspondence with the determination of said degree of ovalization of said first assembly as a function of axial extent of said first assembly whereby said ovalization is substantially eliminated at said hot operating temperature of said engine in a second assembly of said axial sections with said tapered shims disposed between corresponding said flanges; and (f) assembly said axial sections with said tapered shims disposed between corresponding said flanges of said axial sections.

2. The method of claim 1 wherein said flat shims and said tapered shims comprise a high temperature resistant alloy.

3. A method for fabrication of a split compressor case for a gas turbine engine, comprising the steps of:

(a) providing two axial sections defining a split compressor case, said axial sections each having a pair of flanges along the axial extent thereof;

(b) assembling said two axial sections along corresponding said flanges with a flat shim disposed between each corresponding pair of flanges in a first assembly of said two axial sections;

(c) determining, as a function of axial extent of said first assembly, the degree of ovalization of said first assembly when heated to the hot operating temperature of said engine;

(d) providing a pair of tapered shims each having thickness which varies along the length and width thereof in correspondence with the determination of said degree of ovalization of said first assembly as a function of axial extent of said first assembly;

(e) assembling said two axial sections along corresponding said flanges with said tapered shims disposed between each corresponding pair of flanges in a second assembly of said two axial sections;

(f) machining said second assembly to a preselected contour whereby said ovalization is substantially eliminated at said hot operating temperature of said engine in a third assembly of said axial sections with said flat shims disposed between corresponding said flanges; and (g) assembling said axial sections with said flat shims disposed between corresponding said flanges of said axial sections.

4. The method of claim 3 wherein said flat shims and said tapered shims comprise a high temperature resistant alloy.

* * * * *

UNITED STATES PATENT AND TRADEMARK OFFICE

CERTIFICATE OF CORRECTION

PATENT NO. : 5,063,661

DATED : November 12, 1991

INVENTOR(S) : Mitchell H. Lindsay

It is certified that error appears in the above-identified patent and that said Letters Patent is hereby corrected as shown below:

Col. 4, line 2, "f" should read --of--.

Col. 4, line 15, "assembly" should read --assembling--.

Signed and Sealed this

Second Day of March, 1993

*Attest:*

STEPHEN G. KUNIN

*Attesting Officer*

*Acting Commissioner of Patents and Trademarks*